US011231667B2

(12) United States Patent
Sone

(10) Patent No.: US 11,231,667 B2
(45) Date of Patent: Jan. 25, 2022

(54) FIXING DEVICE AND IMAGE FORMING APPARATUS

(71) Applicant: TOSHIBA TEC KABUSHIKI KAISHA, Tokyo (JP)

(72) Inventor: Toshihiro Sone, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/039,404

(22) Filed: Sep. 30, 2020

(65) Prior Publication Data

US 2021/0080882 A1 Mar. 18, 2021

Related U.S. Application Data

(63) Continuation of application No. 16/568,944, filed on Sep. 12, 2019, now Pat. No. 10,831,136.

(51) Int. Cl.
*G03G 15/20* (2006.01)

(52) U.S. Cl.
CPC ..... *G03G 15/2039* (2013.01); *G03G 15/2021* (2013.01)

(58) Field of Classification Search
CPC ..... G03G 15/2017; G03G 15/2021; G03G 15/2039; G03G 2221/1645; G03G 2221/206
USPC ..... 399/38, 67, 69, 122
See application file for complete search history.

(56) References Cited

U.S. PATENT DOCUMENTS

| | | | | |
|---|---|---|---|---|
| 8,521,050 | B2 | 8/2013 | Kuribayashi | |
| 9,207,636 | B1 | 12/2015 | Hamada | |
| 10,261,468 | B2 * | 4/2019 | Kuroda | G03G 21/206 |

FOREIGN PATENT DOCUMENTS

JP 2012194462 A 10/2012

* cited by examiner

*Primary Examiner* — Hoan H Tran
(74) *Attorney, Agent, or Firm* — Kim & Stewart LLP

(57) ABSTRACT

According to an embodiment, a fixing device includes rotating body that is rotatably supported, a heater that heats the rotating body, a pressing body that is pressed against the rotating body to form a nip through which print media passes to a media conveyance path, and a water vapor discharge passage downstream of the nip from rotating body. The water vapor discharge passage is separate and distinct from the media conveyance path. The fixing device may be used in image forming apparatuses and the like.

20 Claims, 9 Drawing Sheets

FIXING DEVICE AND IMAGE FORMING APPARATUS

CROSS-REFERENCE TO RELATED APPLICATION

This application is a continuation of U.S. patent application Ser. No. 16/568,944, filed on Sep. 12, 2019, the entire contents of which are incorporated herein by reference.

FIELD

Embodiments described herein relate generally to a fixing device and an image forming apparatus.

BACKGROUND

A fixing device that is used in an image forming apparatus such as a multi-function peripheral or a laser printer fixes a toner image to paper by heating toner image on the paper. Water vapor is produced from the heated paper. When this water vapor permeates into the sheet conveying path of the printer or the like, the vapor condenses. There is a problem that subsequent sheets of paper being fed through the printer become damp. In addition, when the water vapor interacts with non-contact temperature detection elements such as an infrared temperature sensor, there is a problem that the temperature detection accuracy of these elements may deteriorate.

There are image forming apparatuses that exhaust the water vapor away from the apparatus using a fan to prevent condensation of the water vapor on the conveying path or the non-contact temperature detection elements of the apparatus.

However, when the fan exhausts toward a non-contact temperature detection element, the non-contact temperature detection element is cooled. Therefore, there is a problem that the temperature detection accuracy deteriorates with the usage of the fan. In addition, since the fixing device is also somewhat cooled by the fan, there is a problem that the heating efficiency deteriorates.

DETAILED DESCRIPTION

In at least one embodiment, a fixing device includes a rotating body that is rotatably supported, a heater that heats the rotating body, and a pressing body that is pressed against the rotating body to form a nip through which print media passes to a media conveyance path. A water vapor discharge passage is downstream of the nip from rotating body in a primary rotational direction of the rotating body. The water vapor discharge passage is separate from the media conveyance path.

First Embodiment

Hereinafter, an image forming apparatus according to an embodiment will be described with reference to the drawings. In the description, an XYZ coordinate system including an X-axis, a Y-axis, and a Z-axis perpendicular to each other is used for purposes of explanation.

Figure 1:
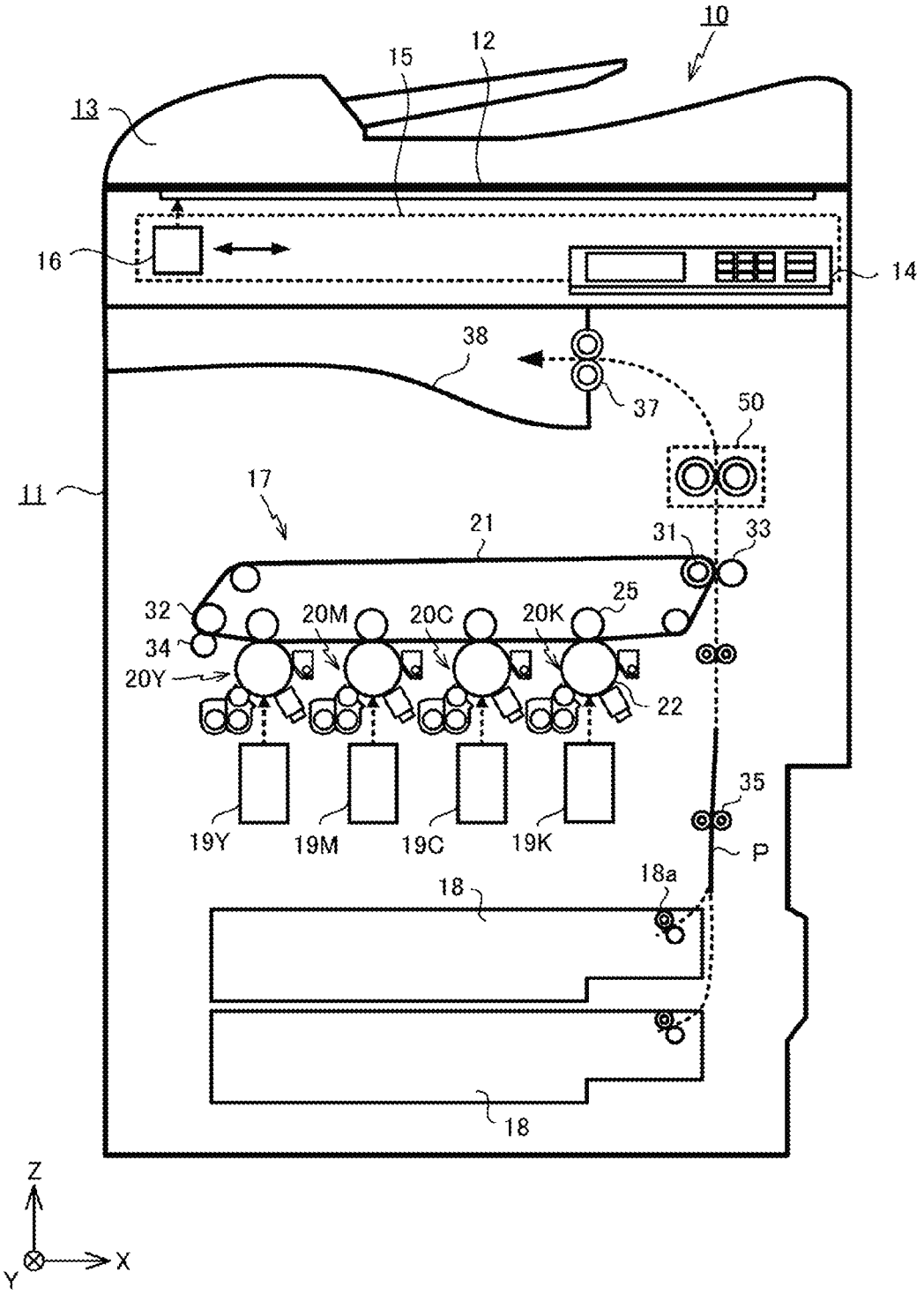
FIG. 1 depicts an image forming apparatus according to a first embodiment.

FIG. 1 is a diagram schematically illustrating a configuration of an image forming apparatus 10 according to an embodiment. The image forming apparatus 10 is, for example, a multi-function peripheral (MFP). The image forming apparatus 10 includes a main body portion 11 and an automatic document feeder (ADF) 13 that is disposed in this example above the main body portion 11. A document platen 12 formed of transparent glass is disposed above the main body portion 11, and the automatic document feeder 13 is pivotably provided on an upper surface side of the document platen 12. In addition, an operation panel 14 is provided above the main body portion 11. The operation panel 14 includes various keys, a graphical user interface (GUI), and the like.

A scanner 15 for reading an original document is provided below the document platen 12. The scanner 15 reads an original document to generate image data. The original document can be conveyed from the automatic document feeder 13 to the document platen 12 or placed on the document platen 12 by a user. The scanner 15 includes an image sensor 16.

When reading an image of an original document placed on the document platen 12, the image sensor 16 reads the image of the original document while moving along the document platen 12 in a+X direction. When reading an image of an original document supplied from the automatic document feeder 13 to the document platen 12, the image sensor 16 is fixed to a position illustrated in FIG. 1 and reads an image of each of the original documents that are sequentially conveyed from the ADF 13.

In the main body portion 11, an image forming unit 17 is provided. The image forming unit 17 forms an image on a recording medium, such as paper fed from a paper feed cassette 18, based on image data read by the scanner 15 or image data generated by or supplied from a personal computer or the like.

The image forming unit 17 includes: image forming units 20Y, 20M, 20C, and 20K that form latent images using toners of yellow (Y), magenta (M), cyan (C), and black (K); scanning heads 19Y, 19M, 19C, and 19K that are provided corresponding to the image forming units; and an intermediate transfer belt 21.

The image forming units 20Y, 20M, 20C, and 20K are disposed below the intermediate transfer belt 21. In the image forming unit 17, the image forming units 20Y, 20M, 20C, and 20K are arranged from a−X side to a+X side. The scanning heads 19Y, 19M, 19C, and 19K are disposed below the image forming units 20Y, 20M, 20C, and 20K, respectively.

Figure 2:
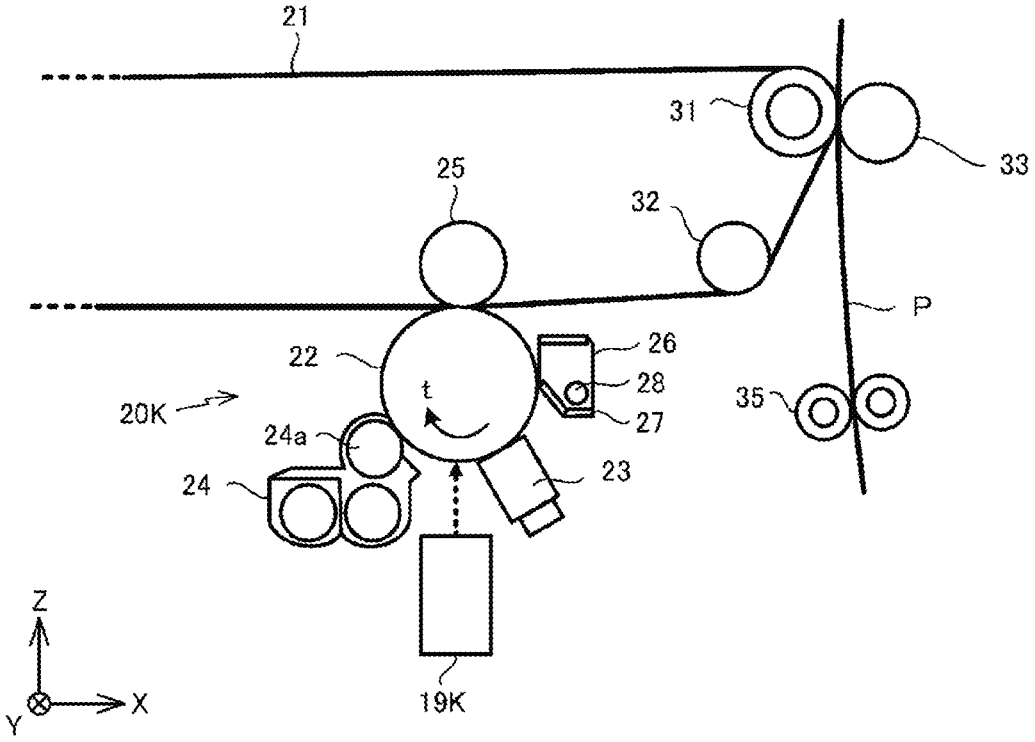
FIG. 2 is an enlarged view illustrating an image forming unit.

FIG. 2 is an enlarged view illustrating the image forming unit 20K among the image forming units 20Y, 20M, 20C, and 20K. The respective image forming units 20Y, 20M, 20C, and 20K have the same configuration. Therefore, the configuration of each of the image forming units will be described by using the image forming unit 20K as an example.

The image forming unit 20K includes a photoconductive drum 22 as an image carrier. In the vicinity of the photoconductive drum 22, an electrostatic charger 23, a developing unit 24, a primary transfer roller 25, a cleaner 26, and the like are disposed along the direction indicated by arrow t. The photoconductive drum 22 is irradiated with laser light from the scanning head 19K at an exposure position. By irradiating the surface of the rotating photoconductive drum 22 with laser light, an electrostatic latent image is formed on the surface of the photoconductive drum 22.

The electrostatic charger 23 of the image forming unit 20K uniformly charges the surface of the photoconductive drum 22. The developing unit 24 develops the electrostatic latent image by supplying toner to the surface of the photoconductive drum 22 using a developing roller 24*a* to which a developing bias is applied. The cleaner 26 removes residual toner on the surface of the photoconductive drum 22 using a blade 27. The toner scraped off by the blade 27 is conveyed in a longitudinal direction by an auger 28.

As illustrated in FIG. 1, the intermediate transfer belt 21 is suspended by a driving roller 31 and three driven rollers 32. The intermediate transfer belt 21 rotates counterclockwise in FIG. 1 as the driving roller 31 rotates. In addition, as illustrated in FIG. 1, the intermediate transfer belt 21 is in contact with an upper surface of each of the photoconductive drums 22 of the image forming units 20Y, 20M, 20C, and 20K. A primary transfer voltage is applied to positions of the intermediate transfer belt 21 facing the photoconductive drum 22 by the primary transfer rollers 25. As a result, the toner image developed on the surface of a photoconductive drum 22 is transferred to the intermediate transfer belt 21 (this is referred to as a primary transfer).

A secondary transfer roller 33 is disposed to face the driving roller 31 that drives the intermediate transfer belt 21. When paper P passes between the driving roller 31 and the secondary transfer roller 33, a secondary transfer voltage is applied to the paper P by the secondary transfer roller 33. As a result, the toner image formed on the intermediate transfer belt 21 is transferred to the paper P (this referred to as a secondary transfer). In the vicinity of the driven roller 32 for the intermediate transfer belt 21, a belt cleaner 34 is provided, as illustrated in FIG. 1. Residual toner on the surface of the intermediate transfer belt 21 is removed by the belt cleaner 34.

As illustrated in FIG. 1, a paper feed roller 35 is provided between the paper feed cassette 18 and the secondary transfer roller 33. The paper P that is picked up from the paper feed cassette 18 by a pick-up roller 18*a* is conveyed by the paper feed roller 35 to a nip formed between the intermediate transfer belt 21 and the secondary transfer roller 33.

A fixing device 50 is provided above the secondary transfer roller 33. In addition, a paper discharge roller 37 is provided above the fixing device 50. The paper P after being passed through the intermediate transfer belt 21 and the secondary transfer roller 33 is heated by the fixing device 50. As a result, the toner image is fixed to the paper P. The paper P after passing through the fixing device 50 is discharged to a paper discharge unit 38 by the paper discharge roller 37.

Figure 3:
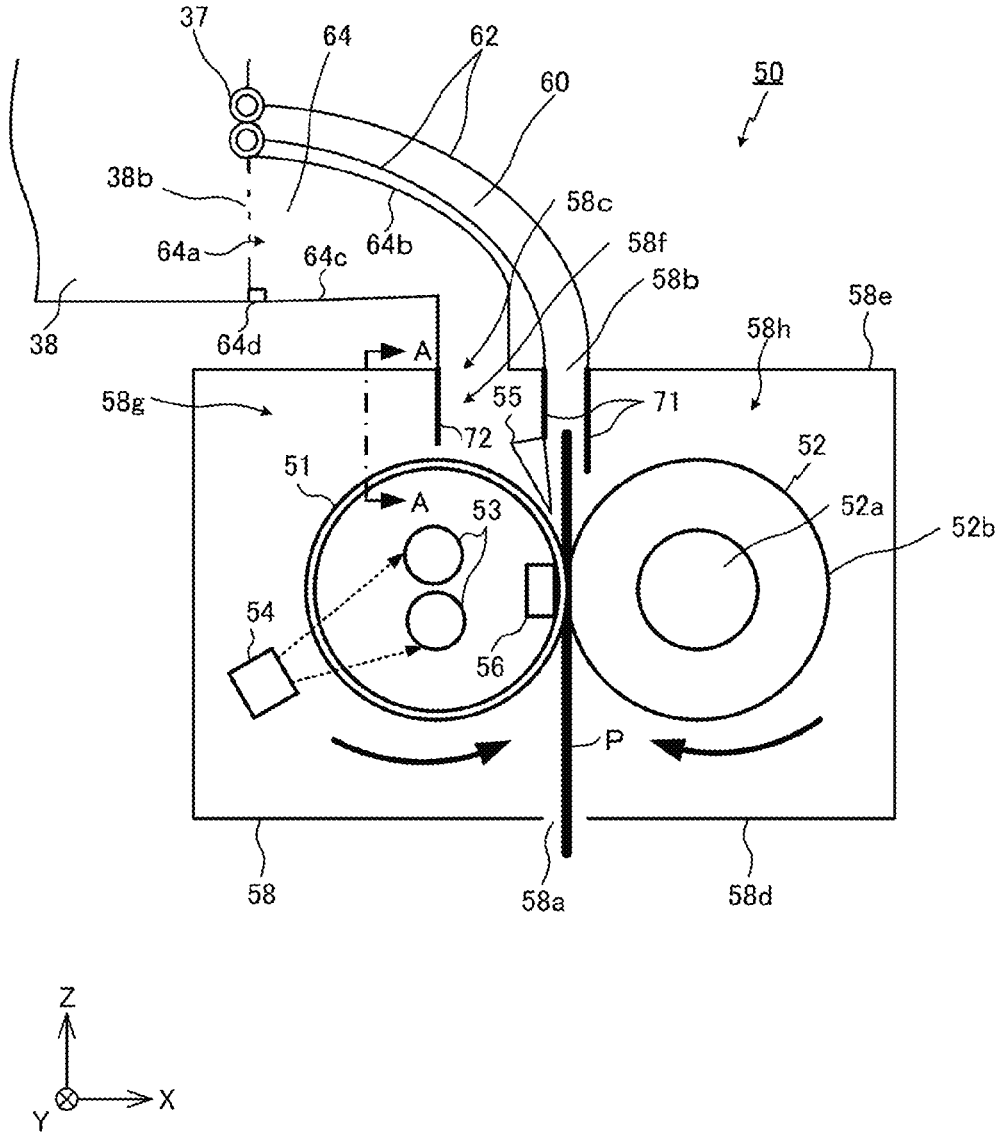
FIG. 3 is a diagram depicting of a fixing device.
Figure 4:
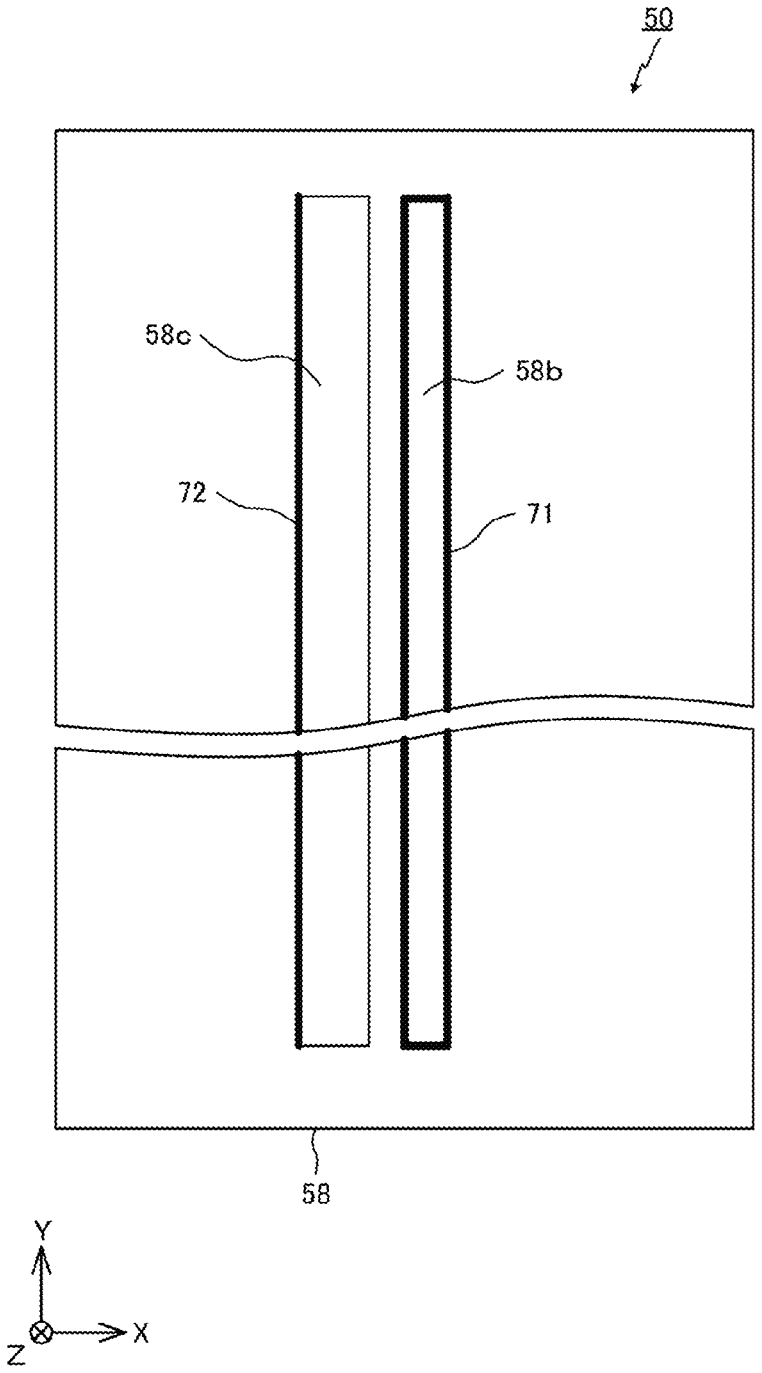
FIG. 4 is a plan view depicting a fixing device.

FIG. 3 is a diagram illustrating an example of the fixing device 50. FIG. 4 is a plan view illustrating the fixing device 50. The fixing device 50 includes a fixing belt 51, a pressing roller 52, a halogen lamp 53, a sensor 54, a release member 55, a nip pad 56, a first partition wall member 71, and a second partition wall member 72. The fixing belt 51, the pressing roller 52, the halogen lamp 53, the sensor 54, the release member 55, the nip pad 56, the first partition wall member 71, and the second partition wall member 72 are accommodated in a case 58.

The fixing belt 51 is formed in a cylindrical shape with an axial direction set to be a Y-axis direction. The width in the axial direction is greater than the width (dimension in the Y-axis direction) of the paper P. The fixing belt 51 is a film formed of, for example, a stainless steel (SUS) base having a thickness of 50 μm or polyimide base having a thickness of 70 μm. A silicone rubber layer having a thickness of 200 μm is formed on the surface of the base. In addition, the silicone rubber layer is covered with a surface protective layer formed of a PFA resin (perfluoroalkoxy resin). The fixing belt 51 is mounted to be rotatable around an axis parallel to the Y-axis.

The pressing roller 52 is a cylindrical member with an axial direction set to be the Y-axis direction. The pressing roller 52 includes: a core 52*a* that is formed of a metal such as iron, stainless steel, or aluminum; and a silicone rubber layer 52*b* that is laminated on an outer circumferential surface of the core 52*a*. The outer surface of the silicone rubber layer 52*b* is covered with a PFA resin. The pressing roller 52 has an outer diameter of about 30 mm and a length that is substantially equal to the width (axial dimension) of the fixing belt 51. The pressing roller 52 is biased in a−X direction toward the fixing belt 51 by an elastic member such as a spring or the like. As a result, the pressing roller 52 is pressed against the nip pad 56 with the fixing belt 51 therebetween. As a result, the surface of the pressing roller 52 and the surface of the fixing belt 51 are in close contact with each other such that the nip through which the paper P passes from below to above (+Z direction) is formed.

The halogen lamp 53 heats the fixing belt 51. The halogen lamp 53 is disposed inside the circumference of the fixing belt 51. The halogen lamp 53 is connected to a fixing control circuit 150 (see illustrated in FIG. 6) and generates heat based on the control of the fixing control circuit 150.

The sensor 54 detects the temperature of the fixing belt 51 as heated by the halogen lamp 53 and outputs a signal having a value corresponding to the detected temperature to the fixing control circuit 150. The sensor 54 is disposed to detect the surface temperature of the fixing belt 51 and is a non-contact infrared temperature detection member in this example. As illustrated in FIG. 3, the sensor 54 is disposed at a position lower than an exit of the nip.

The release member 55 has a longitudinal (longwise) direction is set to be the Y-axis direction. The release member 55 is formed of a resin or the like. The release member 55 functions to release the paper P from the fixing belt 51 and help convey or direct the paper P to the conveying path 60 for conveying sheets to the paper discharge unit 38.

The nip pad 56 has a longitudinal direction is set to be the Y-axis direction. The nip pad is formed of a resin such as silicon rubber or the like. The nip pad 56 presses the paper P against the pressing roller 52 through the fixing belt 51.

The case 58 accommodates the fixing belt 51, the pressing roller 52, and the like. The case 58 is formed of a resin in this example. The case 58 includes an insertion hole 58*a* for the paper P on a bottom surface 58*d* and a discharge hole 58*b* for the paper P on an upper surface 58*e*. In addition, the case includes an opening 58*c* of the upper surface 58*e*. The opening 58*c* serves to discharge water vapor accumulated in the case 58 to a position downstream of the first partition wall member 71 in a rotational direction of the fixing belt 51.

The first partition wall member 71 has a longitudinal direction set to be the Y-axis direction. The first partition wall member 71 is formed of a resin that does not allow substantial permeation of water vapor. The first partition wall member 71 is provided to prevent water vapor from permeating from spaces 58*f* and 58*h* that are downstream of the nip into the conveying path 60 through which the paper P is conveyed to the paper discharge unit 38. The first partition wall member 71 is extends toward the nip from the conveying path 60. Specifically, one end of the first partition wall member 71 on one side is connected to the release member 55, and the other end of the first partition wall member 71 on that side is connected to a guide member 62 that forms the conveying path 60. Another side of the first partition wall 71 is connected to a guide member 62 and protrudes (−Z direction) towards the interior of case 58. As illustrated in FIG. 4, the first partition wall member 71 surrounds the discharge hole 58*b* for the paper P. The opening 58*c* in the case 58 next to the discharge hole 58 provides a water vapor discharge path through which water vapor produced from the paper P can be discharged from the fixing device 50.

The second partition wall member 72 has a longitudinal direction set to be the Y-axis direction. The second partition wall member 72 is formed of a resin that does not substantially allow permeation of water vapor. As can be understood with reference to FIGS. 3 and 4, the second partition wall member 72 protrudes toward the fixing belt 51 (−Z direction) from an edge (−X side) of the opening 58*c* on a downstream side in the primary rotational direction (arrow direction in FIG. 3) of the fixing belt 51. The second partition wall member 72 is provided to prevent water vapor from permeating from the space 58*f* to the space 58*g* that is the interior space of the case 58 is partially partitioned by the second partition wall member 72. More particularly, the second partition wall member 72 inhibits the permeation of water vapor to the sensor 54 by narrowing, partially blocking the available passageway between these spaces 58*f* and 58*g*.

Figure 5:
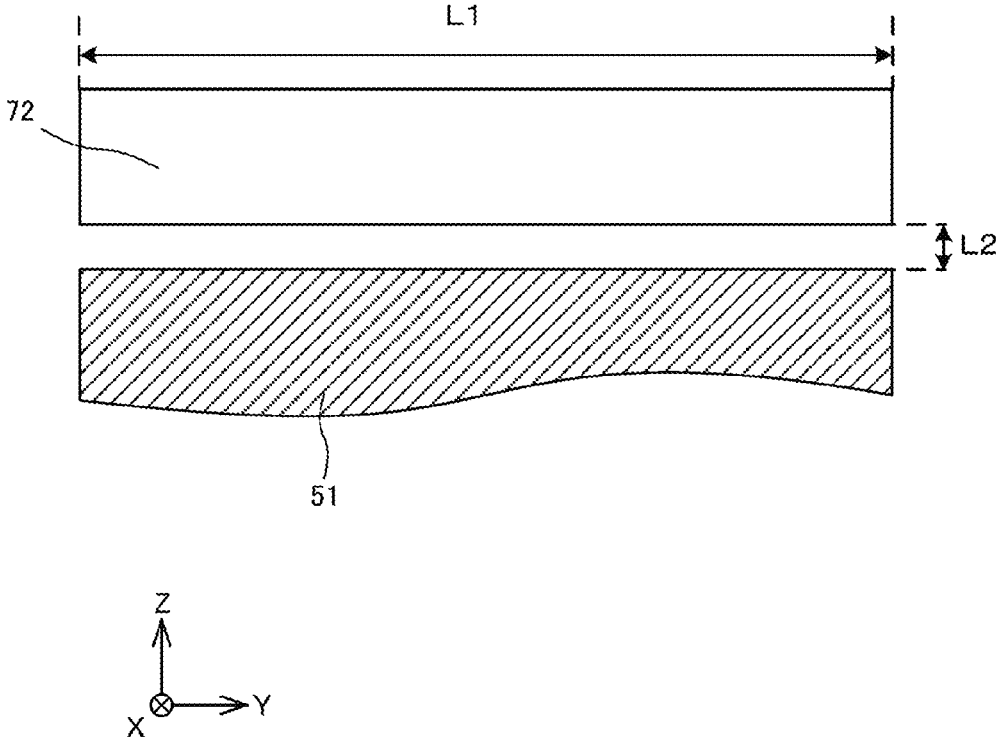
FIG. 5 is a diagram illustrating a second partition wall member.

FIG. 5 is a diagram illustrating a cross-section of the fixing device 50 taken along line AA in FIG. 3. L1 represents the length of the second partition wall member 72 in the Y direction. L2 represents the distance between the second partition wall member 72 and the fixing belt 51. L2 is, for example, 1 mm to 5 mm. Preferably, L2 is about 2 mm since, while it is preferable that L2 be as short as possible, the gap (L2) tends to vary because the fixing belt 51 vibrates and thus varies in position with the passage of the paper P and the like. Accordingly, L2 is set as a distance at which the second partition wall member 72 and the fixing belt 51 are not expected to contact with each other even if the fixing belt 51 vibrates.

When the area of the gap formed between the second partition wall member 72 and the fixing belt 51 is represented by S1 and the opening area of the opening 58*c* is represented by S2, L2 is set to satisfy Expression 1.

$$S1<S2 \quad \text{(Expression 1)}$$

In this context, S1 can be calculated as S1=L1×L2.

Returning to FIG. 3, a duct 64 provides a route to discharge water vapor accumulated in the fixing device 50 to the outside of the apparatus. As illustrated in FIG. 3, the duct 64 is formed adjacent to the conveying path 60 from the opening 58*c* to a vent portion 38*b* that is formed on a side surface of the paper discharge unit 38. One end of the duct 64 is connected to the opening 58*c*, and the other end of the duct 64 is connected to the vent portion 38*b*. The vent portion 38*b* is a gap leading from the duct 64 to the paper discharge unit 38. The duct 64 is formed of a resin. The resin that forms the duct 64 is substantially impermeable to water vapor (and water) such that water vapor is prevented from leaking.

When an opening area of the duct 64 on a side to which water vapor is input (i.e., the side connected to the opening 58*c*) is represented by S2 and an opening area of the duct 64 on a side from which water vapor is discharged (exit 64*a* side) is represented by S3, the duct 64 is formed to satisfy Expression 2.

$$S3>S2 \quad \text{(Expression 2)}$$

Furthermore, the duct 64 is formed such that the internal space of the duct gradually becomes wider as the duct 64 approaches the exit 64*a* from the opening 58*c*.

In addition, the duct 64 includes a discharge hole 64*d* through which condensed water vapor can be discharged. The discharge hole 64*d* can be connected to a tank or reservoir within the apparatus or simply to the outside of the apparatus.

Figure 6:
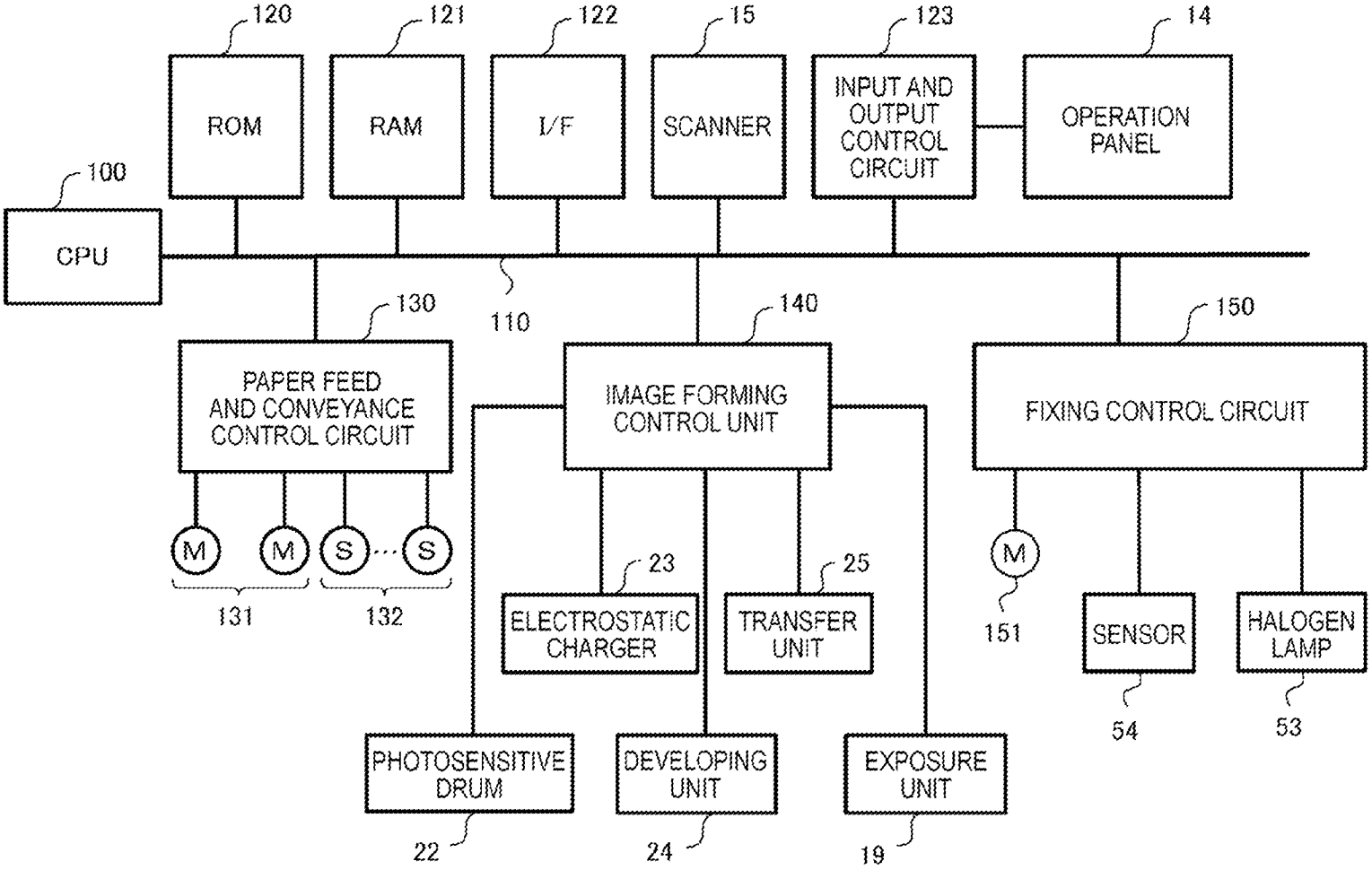
FIG. 6 is a block diagram illustrating aspects of control system of an image forming apparatus.

FIG. 6 is a block diagram illustrating a control system that constitutes the image forming apparatus 10. The control system includes, for example, a CPU 100 that controls the entire image forming apparatus, a bus line 110, a read-only memory (ROM) 120, a random access memory (RAM) 121, an interface 122, the scanner 15, an input and output control circuit 123, a paper feed and conveyance control circuit 130, an image forming control circuit 140, and the fixing control circuit 150. The CPU 100 and each of the circuits are connected to each other through the bus line 110.

The ROM 120 stores a control program, control data, and the like that regulate a basic operation of an image forming process.

The RAM 121 functions as a working memory that is a work area of the CPU 100.

The CPU 100 executes the program stored in the ROM 120. As a result, each of the components in the image forming apparatus 10 is integrally controlled by the CPU 100 and sequentially executes processes for forming an image on paper.

The interface 122 communicates with a device such as a terminal to be used by a user. The input and output control circuit 123 displays required information on the operation panel 14 or receives an input from the operation panel 14. The user of the image forming apparatus 10 can designate, for example, the paper size or the number of copies of an original document by operating the operation panel 14.

The paper feed and conveyance control circuit 130 is a unit that controls a motor group 131 that drives the pick-up roller 18*a*, the paper feed roller 35, the paper discharge roller 37 of the conveying path 60, or the like. The paper feed and conveyance control circuit 130 controls the motor group 131 based on a control signal from the CPU 100 according to detection results of various sensors 132 that are provided in the vicinity of the paper feed cassette 18 or in the conveying path or the like.

The image forming control circuit 140 controls each of the photoconductive drum 22, the electrostatic charger 23, the scanning heads 19Y, 19M, 19C, and 19K, the developing unit 24, and the primary transfer roller 25 based on a control signal from the CPU 100.

The fixing control circuit 150 controls a drive motor 151 that rotates the pressing roller 52 of the fixing device 50, based on a control signal from the CPU 100. In addition, the fixing control circuit 150 controls the temperature of the halogen lamp 53 based on a signal output from the sensor 54 such that the temperature of the nip portion is an appropriate fixing temperature. Since the sensor 54 detects the temperature of the halogen lamp 53, there is a temperature difference between the halogen lamp 53 and the nip portion. The fixing control circuit 150 performs a correction process for the temperature difference based on experimental data simulations and controls the temperature of the halogen lamp 53.

The image forming apparatus 10 performs an image forming process for printing an image on the paper P according to a print instruction from the user. The image forming process is performed, for example, when image data received through the interface 122 is printed or when image data generated by the scanner 15 is printed.

In the image forming process, as illustrated in FIG. 1, the paper P is drawn out from the paper feed cassette 18 by the pick-up roller 18*a* and is conveyed to a gap between the intermediate transfer belt 21 and the secondary transfer roller 33 by the paper feed roller 35.

Concurrently with the above-described operation, the toner images are formed on the photoconductive drums 22 in the image forming units 20Y, 20M, 20C, and 20K, respectively. The toner images formed on the photoconductive drums 22 in the respective image forming units 20Y, 20M, 20C, and 20K are sequentially transferred to the intermediate transfer belt 21. As a result, a toner image including the yellow (Y) toner, the magenta (M) toner, the cyan (C) toner, and the black (K) toner is formed on the intermediate transfer belt 21.

When the paper P conveyed to the gap between the intermediate transfer belt 21 and the secondary transfer roller 33 passes through the intermediate transfer belt 21 and the secondary transfer roller 33, the toner image formed on the intermediate transfer belt 21 is transferred to the paper P. As a result, a toner image including the toners of yellow (Y), magenta (M), cyan (C), and black (K) is formed on the paper P.

The paper P then passes through the fixing device 50. The fixing control circuit 150 controls the temperature of the halogen lamp 53 based on a signal output from the sensor 54 such that the temperature of the nip portion is a target temperature. The target temperature is set as, for example, 135° C.

The fixing control circuit 150 heats the fixing belt 51 up to the target temperature. The paper P is heated by passing through the fixing device 50. As a result, the toner image previously transferred to the paper P is fixed to the paper P to form an image on the paper P. The paper P on which the image is formed is discharged to the paper discharge unit 38 by the paper discharge roller 37.

Next, the flow of water vapor in the fixing device 50 will be described with reference to FIG. 7. The paper P is heated to 100° C. or higher when passing through the nip. Due to this heating, water in the paper P is evaporated to produce water vapor by the heating in the nip.

In the vicinity of the nip, air flow is produced along the rotation direction of the fixing belt 51 due to the rotation of the fixing belt 51 in a high-temperature state. Along with this air flow, generated water vapor (from the paper P) passes through a gap between the release member 55 and the fixing belt 51 and flows upward toward the space 58*f* above (+Z direction) the fixing belt 51. The space 58*f* is downstream of the nip in the rotation direction of the fixing belt 51.

The inside of the conveying path 60 and the space 58*f* are separated from each other by the first partition wall member 71. Accordingly, the water vapor moved up to the space 58*f* is prevented from permeating into the conveying path 60. As a result, condensation of the water vapor in the conveying path 60 can be inhibited since a separate water vapor exit way is provided.

Figure 7:
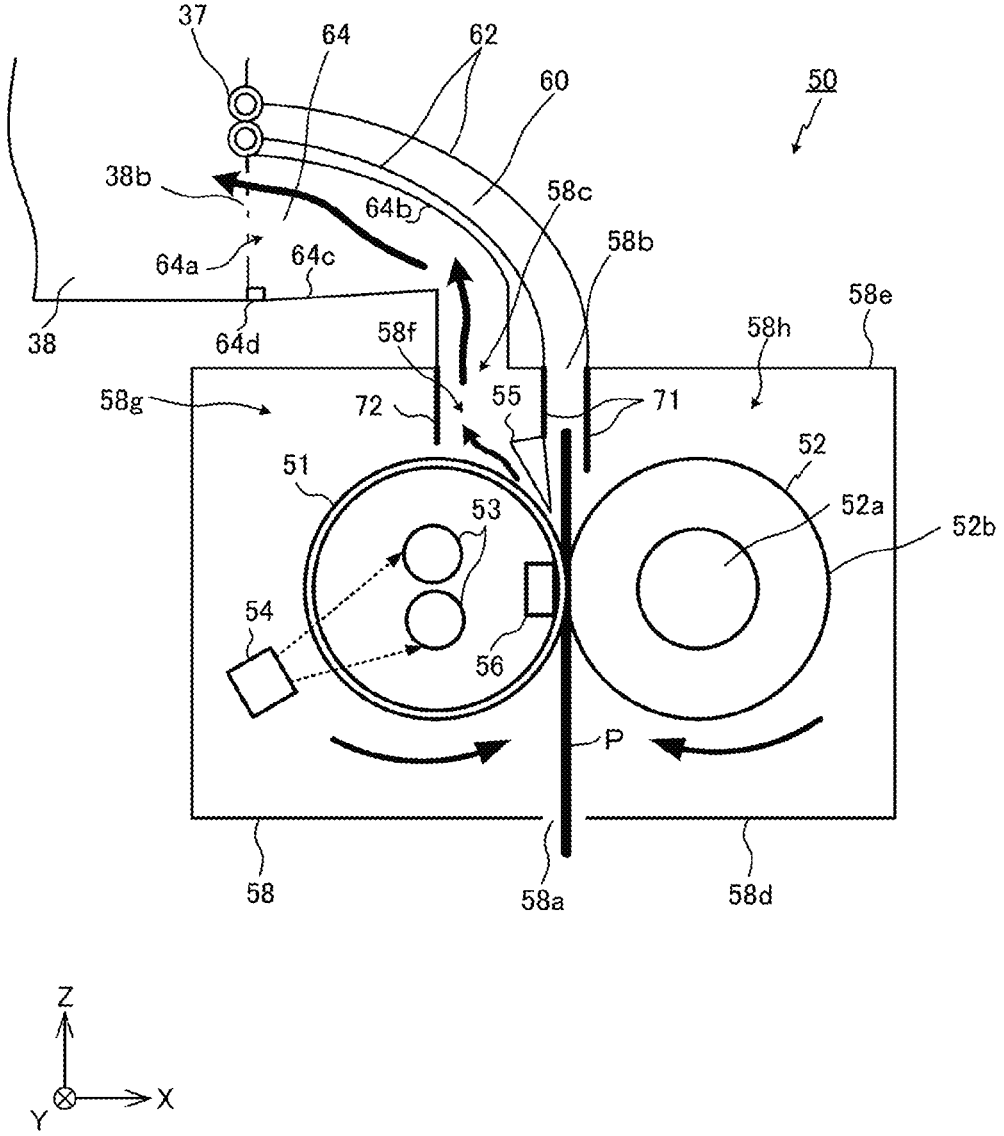
FIG. 7 depicts aspects of an operation of a fixing device.

The water vapor in the space 58*f* tends to flow in the −X direction along with the air flow as illustrated in FIG. 7. However, the water vapor is inhibited from moving into the space 58*g* by the second partition wall member 72. The area S1 of the gap formed between the second partition wall member 72 and the fixing belt 51 is narrower than the opening area S2 of the opening 58*c* which promotes vapor flow through the opening 58*c*. In addition, the atmospheric pressure in the duct 64 portion is generally lower than regions closer to the fixing belt 51 since the duct 65 portions tend to be a lower temperature than the temperature of the air flows produced in the rotation direction of the (heated) fixing belt. Thus, the water vapor is likely to flow toward the duct 64 portions. Further, given the relative sizing of the available openings between the space 58*g* and duct 64 from space 58*f*, the flow resistance facing water vapor moving from the space 58*f* toward the duct 64 is lower than the flow resistance facing the water vapor moving from the space 58*f* toward the space 58*g*. Accordingly, the water vapor tends to move up from the opening 58*c* toward the duct 64. As a result, the flowing of the water vapor toward the space 58*g* side is inhibited, and the interaction of water vapor with the sensor 54 is inhibited.

The temperature of the pressing roller 52 is lower than that of the fixing belt 51 and the temperature of the fixing belt side and the temperature of the image surface side of the recording medium are higher. Therefore, water vapor is considered to be mainly produced from the fixing belt side, and thus the amount of water vapor moving up toward the space 58*h* above the pressing roller 52 is relatively small. As illustrated in FIGS. 3 and 4, the internal space of the conveying path 60 and the space 58*h* are separated from each other by the first partition wall member 71 that protrudes from the upper surface 58*e* of the case 58 in the −Z direction. Accordingly, the water vapor in the space 58*h* can pass through an end gap between the first partition wall member 71 and the case 58 in the y-direction to be discharged from the opening 58*c* without flowing into the conveying path 60. As a result, condensation of the water vapor in the conveying path 60 can be inhibited.

The duct 64 is formed such that the internal space of the duct gradually becomes wider as the duct 64 approaches the exit 64*a* from the opening 58*c*. Accordingly, the water vapor expands along the rise from the opening 58*c* toward the inside of the duct 64. That is, regarding the internal atmospheric pressure of the duct 64, the atmospheric pressure on the exit side becomes lower than that on the entrance side as the area of the space becomes wider. Due to this difference in atmospheric pressure, the water vapor is taken up from the space 58*f* to the exit 64*a* of the duct 64.

The exit 64*a* of the duct 64 is connected to the vent portion 38*b* of the paper discharge unit 38 such that the water vapor is discharged from the paper discharge unit 38 to the outside of the apparatus.

Any portion of the water vapor cooled to the condensation point in the duct 64 flows as condensed water to the discharge hole 64*d* through the lower surface 64*c* of the duct 64 and is discharged to the tank or reservoir in the apparatus or otherwise to the outside of the apparatus.

In the guide member 62 that forms the conveying path 60, it is necessary to provide a roller for conveying the paper P or to provide a hole for taking out the paper P clogged in the conveying path 60. Therefore, in many cases, the guide member 62 does not have a watertight structure. However, an upper wall 64*b* of the duct 64 is formed of a material that does not allow permeation of water vapor. Therefore, the water vapor moved up to the inside of the duct 64 does not leak from the inside of the duct 64 to the conveying path 60.

Modification Example 1

In the first embodiment, the case where the fixing device includes the cylindrical fixing belt 51 is described. However, the fixing belt 51 is not limited thereto. For example, as illustrated in FIG. 8, the image forming apparatus 10 may also include a fixing device 300 including the fixing belt 51 that is suspended by a plurality of rollers.

Figure 8:
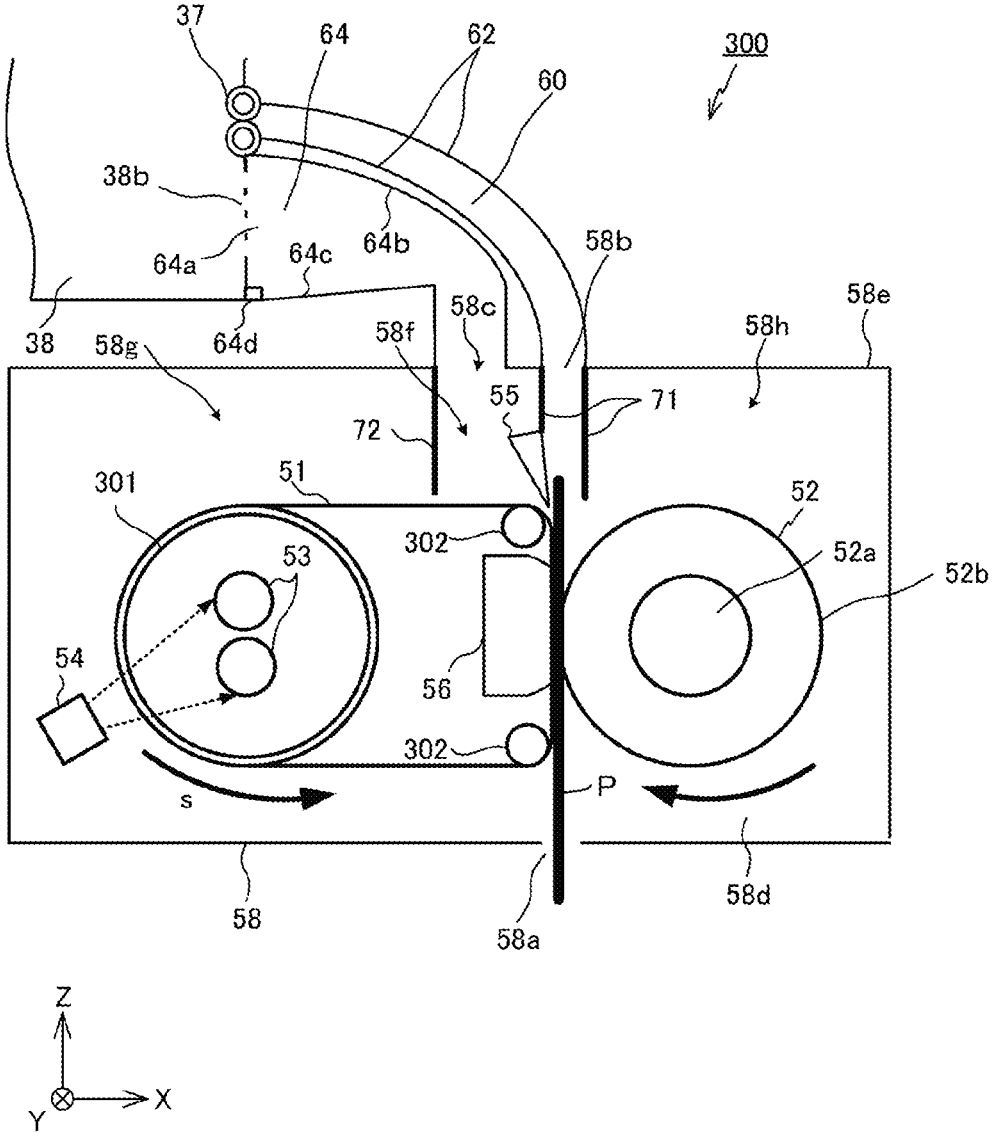
FIG. 8 is a diagram illustrating a fixing device according to Modification Example 1.

As illustrated in FIG. 8, in the fixing device 300, the fixing belt 51 is suspended by a driving roller 301 for rotating the fixing belt 51 and tension rollers 302 for applying tension to the fixing belt 51. The fixing belt 51 rotates in a direction indicated by arrow s by the driving roller 301.

In the fixing device 300, the fixing belt 51 is heated by the halogen lamp 53 disposed inside the fixing belt 51. The fixing belt 51 is pressed against the pressing roller 52 by the nip pad 56 such that a nip is formed between the fixing belt 51 and the pressing roller 52. The paper P to which the toner image was transferred passes through the nip such that the paper P is heated by the halogen lamp 53 through the fixing belt 51. As a result, the toner image is fixed to the paper P such that an image is formed on the paper P.

The structures of the first partition wall member 71, the second partition wall member 72 and the case 58 and the flow of water vapor are the same as described above in the first embodiment.

Modification Example 2

In the first embodiment, the fixing device 50 is a fixing device using a halogen lamp 53 to heat the paper P through the film-like fixing belt 51. However, the method is not limited thereto, and the fixing device 50 may be a fixing device that utilizes an induction heating method for causing a high-frequency current to flow the fixing belt 51 to thereby heat the fixing belt 51.

As described above, the fixing device 50 of the first embodiment includes a water vapor discharge path that is positioned downstream of the nip in the rotation direction of the fixing belt 51 and discharges water vapor produced from the paper P from the inside of the device. As a result, the water vapor remaining in the space 58*f* positioned downstream of the nip in the rotation direction of the fixing belt 51 can be inhibited from permeating into the conveying path 60 and then condensing in the conveying path 60.

Specifically, the water vapor discharge path is formed to include the first partition wall member 71 and the opening 58*c*. Since the space 58*f* including a large amount of water vapor is separated from the conveying path 60 by the first partition wall member 71, the water vapor can be inhibited from permeating into the conveying path 60 and condensing in the conveying path 60. In addition, since the water vapor is discharged from the opening 58*c*, the water vapor can be inhibited from permeating throughout the case 58 and attaching to the sensor 54. Therefore, the temperature detection accuracy of the sensor 54 can be prevented from deteriorating.

The sensor 54 is disposed in a non-contact manner with the fixing belt 51 and thus is not directly heated by the fixing belt 51. The surface temperature of the sensor 54 is typically a temperature of about 30° C. during printing operations. When the opening 58*c* is not present in the case 58, water vapor accumulates in the case 58 and can be condensed on the relatively cold temperature detection portion of the sensor 54. When the water vapor is condensed in or on the temperature detection portion of the sensor 54, the temperature detection portion functions as a lens to refract light. Therefore, the temperature detection accuracy of the sensor 54, which uses infrared temperature detection members deteriorates.

In addition, the fixing device 50 includes the second partition wall member 72 that protrudes toward the fixing belt 51 from the end of the opening 58*c* on the downstream side in the rotation direction of the fixing belt 51. The second partition wall member 72 prevents the water vapor that flows along with the air flow in the rotation direction of the fixing belt 51 from flowing from the space 58*f* into the space 58*g*. As a result, water vapor can be inhibited from being attached to the sensor 54, and the temperature detection accuracy of the sensor can be inhibited from deteriorating.

In addition, the area S1 of the gap formed between the second partition wall member 72 and the fixing belt 51 is formed to be narrower than the opening area S2 of the opening 58*c*. As a result, the water vapor remaining in the space 58*f* is more likely to flow toward the duct 64 side rather than the space 58*g*. Accordingly, the water vapor remaining in the space 58*f* can be inhibited from flowing into the space 58*g*. As a result, water vapor can be inhibited from permeating to and being attached to the sensor 54, and the temperature detection accuracy of the sensor can be inhibited from deteriorating.

In addition, the sensor 54 is disposed at a position lower than the exit of the nip. As a result, the water vapor can be inhibited from permeating to the sensor 54. Accordingly, the sensor 54 can more accurately detect the temperature of the fixing belt 51.

In addition, one end of the first partition wall member 71 is connected to the release member 55, and the other end of the first partition wall member 71 is connected to the guide member 62 that forms the conveying path 60. As a result, the water vapor remaining in the space 58*f* can be inhibited from permeating into the conveying path 60 and being condensed in the conveying path 60.

In addition, the duct 64 that discharges water vapor accumulated in the case 58 to the outside of the image forming apparatus is connected to the opening 58*c*. The duct 64 is connected to the vent portion 38*b* formed in the paper discharge unit 38. The water vapor having passed through the duct 64 is discharged to the outside of the image forming apparatus through the vent portion 38*b*. As a result, the water vapor can be prevented from excessively accumulating in the fixing device 50 and can be inhibited from permeating into the conveying path 60 and being condensed in the conveying path 60.

In addition, the opening area S2 of the duct 64 on the side connected to the opening 58*c* is formed to be narrower than the opening area S3 of the duct 64 on the exit 64*a* side that is the side from which water vapor is discharged. That is, the internal space of the duct 64 gradually becomes wider along the route in which water vapor moves up. When water vapor passes through the duct 64 having the above-described structure, the water vapor expands along the rise. That is, regarding the internal atmospheric pressure of the duct 64, the atmospheric pressure on the exit side is lower than that on the entrance side since the area of the space becomes wider. Due to this difference in atmospheric pressure, the water vapor is taken up from the space 58*f* to the exit 64*a* of the duct 64. Accordingly, the water vapor can be discharged to the outside of the image forming apparatus 10 without using a fan.

In addition, in the fixing device 50 according to the embodiment, no fan is used. Therefore, there are no problems with temperature detection accuracy or heating efficiency that would be caused by cooling with a fan.

In addition, the duct 64 is formed of a material that does not allow permeation of water vapor. As a result, the water vapor in the duct 64 can be inhibited from permeating into the conveying path 60 and being condensed in the conveying path 60.

In addition, the duct 64 includes the discharge hole 64*d* through which water vapor condensed in the duct 64 is discharged. As a result, the water vapor condensed in the duct can be discharged to the outside of the image forming apparatus 10.

In the above description, one end of the first partition wall member 71 is connected to the release member 55. However, in other examples, both of these components (71 and 55) are not necessarily connected to the other. In general, any structure that blocks the water vapor in the space 58*f* from permeating into the conveying path 60 can be adopted. For example, a first partition wall member 71 that protrudes from the upper surface 58*e* of the case 58 by about 5 mm to 15 mm in the −Z direction but is not connected to the release member 55 can be adopted since the water vapor in the case 58 still tends to be discharged from the opening 58*c* before permeating into the conveying path 60. In addition, the first partition wall member 71 may also have the release function of the release member 55 integrated therein.

In addition, in the description using FIG. 4, the opening 58*c* is one continuous hole. However, the opening 58*c* is not particularly limited in shape so long as the opening 58*c* can discharge water vapor, and may be, for example, formed of a plurality of holes or slots. In addition, the discharge hole 58*b* for the paper P and the opening 58*c* may be directly adjacent to or spaced from each other.

In addition, in the above description, the duct 64 is connected to the vent portion 38*b* of the paper discharge unit 38. However, the discharge hole of the duct 64 is not necessarily limited to the paper discharge unit 38. For example, the discharge hole of the duct 64 may be provided on a side surface or the like of the apparatus. In this case, it is not necessary to provide the duct 64 to be along the conveying path 60. In general, the form/shape of the duct 64 varies depending on the positions of the fixing device 50 and the duct 64 within the image forming apparatus and the shape/form and positioning of the duct 64 is thus not particularly limited.

In addition, in the above description, the duct 64 is a component formed of a resin. However, the duct 64 may merely be a space formed or left between various components of the apparatus functioning as walls of the duct (space) 64.

In the above description, the sensor 54 detects the temperature of the halogen lamp 53. However, the sensor 54 may instead detect the temperature of the fixing belt 51 in the vicinity of the nip.

Second Embodiment

In the first embodiment, a case where the halogen lamp 53 is used as a heat source that heats the fixing belt 51, and the non-contact infrared temperature detection member is used as the sensor 54 is described. In a second embodiment, a case where an on-demand type heater 53*b* is used as a heat source, and a sensor 54*b*, using a thermistor, detects the temperature of the fixing belt 51 is described with reference to FIG. 9.

Figure 9:
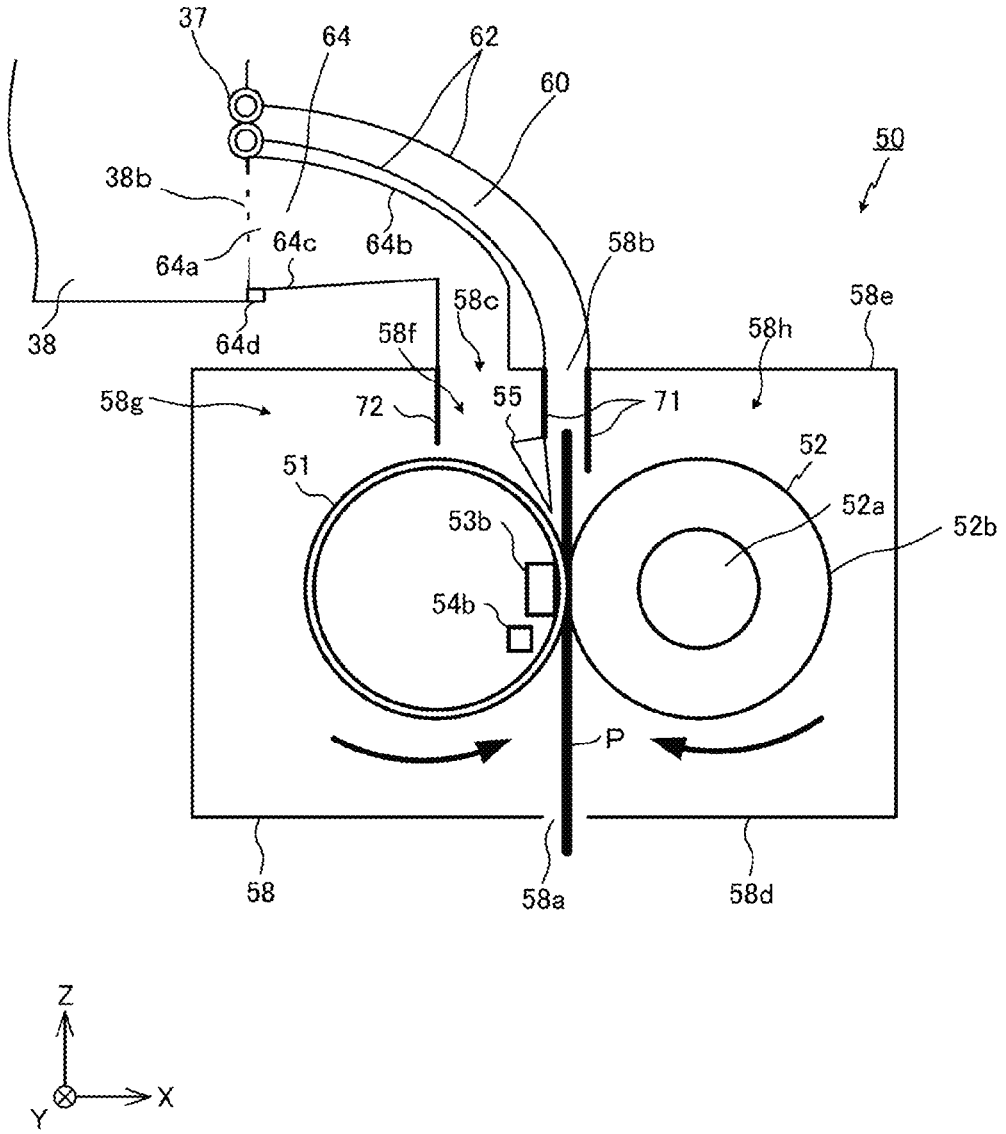
FIG. 9 is a diagram illustrating a fixing device according to a second embodiment.

As illustrated in FIG. 9, the fixing device 50 according to the second embodiment is substantially the same as the fixing device 50 according to the first embodiment except for the heater 53*b* and the sensor 54*b*.

The heater 53*b* is has a length in the y direction that is substantially equal to the length of the fixing belt 51. The heater 53*b* is disposed inside the circumference of the fixing belt 51. In the heater 53*b*, for example, a heat generating layer including a TaSiO-based, TaSiNO-based, NbSiO-based, or TiSiCO-based resistor material is formed on a ceramic substrate. The heater 53*b* is connected to the fixing control circuit 150 and generates heat based on the control of the fixing control circuit 150.

The sensor 54*b* detects the temperature of the fixing belt 51 and outputs a signal having a value corresponding to the detected temperature to the fixing control circuit 150. The sensor 54*b* is constituted of a contact type temperature detection member such as a thermistor. As illustrated in FIG. 9, the sensor 54*b* is disposed further toward the −Z direction than the heater 53*b*. The sensor 54*b* can be a plurality of sensors that are disposed in the vicinity of both ends of the fixing belt 51 in the Y-axis direction and the center of the fixing belt 51.

The flow of water vapor evaporated from the paper P is substantially the same as in the description of the first embodiment. However, in the fixing device 50 according to the second embodiment, since the sensor 54*b* is close to the fixing belt having a high temperature, the sensor 54*b* also has a high temperature. Thus, water vapor is not likely to be attached to the sensor 54*b* and then condensed. Therefore, even when water vapor flowing into the space 58*f* permeates to the sensor 54*b*, there is no significant problem. Accordingly, the second partition wall member 72 can be omitted in some possible examples.

In the embodiments, a case where the image forming apparatus 10 is a multi-function peripheral is described. However, the image forming apparatus 10 is not limited thereto and may be a laser printer or the like.

While certain embodiments have been described, these embodiments have been presented by way of example only, and are not intended to limit the scope of the present disclosure. Indeed, the novel embodiments described herein may be embodied in a variety of other forms; furthermore, various omissions, substitutions and changes in the form of the embodiments described herein may be made without departing from the spirit of the present disclosure. The accompanying claims and their equivalents are intended to cover such forms or modifications as would fall within the scope and spirit of the present disclosure.

What is claimed is:

1. A fixing device, comprising:

a rotating body;

a heater that heats the rotating body;

a pressing body that presses against the rotating body to form a nip through which print media passes; and a case that surrounds the rotating body and the pressing body and has a discharge hole for discharge of the print media and an opening separated from the discharge hole by a partition wall member.

2. The fixing device according to claim 1, wherein the partition wall member extends from an edge of the discharge hole.

3. The fixing device according to claim 1, wherein the opening is above the rotating body.

4. The fixing device according to claim 3, wherein
the case has a second partition wall member,
one end of the second partition wall member is connected to the case, and
another end of the second partition wall member is above the rotating body.

5. The fixing device according to claim 1, wherein one end of the partition wall member is connected to the case and another end of the partition wall member is above the rotating body.

6. The fixing device according to claim 5, wherein the pressing body rotates to convey the print media from a lower side of the nip to an upper side of the nip.

7. The fixing device according to claim 1, wherein
the case has a second partition wall member,
one end of the second partition wall member is connected to the case, and
another end of the second partition wall member is above the rotating body.

8. The fixing device according to claim 7, wherein a gap between the second partition wall member and the rotating body is narrower than the opening.

9. The fixing device according to claim 1, further comprising:
a sensor configured to detect a temperature of the rotating body.

10. The fixing device according to claim 1, further comprising:
a release member positioned to release print media from the rotating body, wherein
an end of the partition wall member is connected to the release member.

11. An image forming apparatus, comprising:
an image forming unit configured to form a toner image on a recording medium; and
a fixing device configured to fix the toner image to the recording medium, the fixing device comprising:
a rotating body;
a heater that heats the rotating body;
a pressing body that presses against the rotating body to form a nip through which print media passes; and
a case that surrounds the rotating body and the pressing body and has a discharge hole for discharge of the print media and an opening separated from the discharge hole by a partition wall member.

12. The image forming apparatus according to claim 11, wherein the partition wall member extends from an edge of the discharge hole.

13. The image forming apparatus according to claim 11, wherein the opening is above the rotating body.

14. The image forming apparatus according to claim 13, wherein
the case has a second partition wall member,
one end of the second partition wall member is connected to the case, and
another end of the second partition wall member is above the rotating body.

15. The image forming apparatus according to claim 11, wherein one end of the partition wall member is connected to the case and another end of the partition wall member is above the rotating body.

16. The image forming apparatus according to claim 15, wherein the pressing body rotates to convey the print media from a lower side of the nip to an upper side of the nip.

17. The image forming apparatus according to claim 11, wherein
the case has a second partition wall member,
one end of the second partition wall member is connected to the case, and
another end of the second partition wall member is above the rotating body.

18. The image forming apparatus according to claim 17, wherein a gap between the second partition wall member and the rotating body is narrower than the opening.

19. The image forming apparatus according to claim 11, further comprising:
a sensor configured to detect a temperature of the rotating body.

20. The image forming apparatus according to claim 11, further comprising:
a release member positioned to release print media from the rotating body, wherein
an end of the partition wall member is connected to the release member.

* * * * *